US005947270A

United States Patent [19]

Lindholm

[11] Patent Number: 5,947,270

[45] Date of Patent: Sep. 7, 1999

[54] RESET SWITCH WITH CONTROLLED FORCE STRENGTH SNAP-OVER

[75] Inventor: Gregory A. Lindholm, Asheville, N.C.

[73] Assignee: Honeywell Inc., Minneapolis, Minn.

[21] Appl. No.: 08/933,187

[22] Filed: Sep. 18, 1997

[51] Int. Cl.[6] ..... H01H 5/22

[52] U.S. Cl. ..... 200/460; 200/461

[58] Field of Search ..... 200/409, 445, 200/451, 459, 460, 461, 467, 245, 246

[56] References Cited

U.S. PATENT DOCUMENTS 2,304,400 12/1942 Eaton ..... 200/461

3,476,898 11/1969 Ehrenfels et al. ..... 200/461

*Primary Examiner*—Renee S. Luebke

*Attorney, Agent, or Firm*—Roland W. Norris

[57] ABSTRACT

A nonrecycling reset switch has a fixed position anchor mounted on bosses in the casing for holding a resilient member of the conductive snap spring which moves between open and closed positions. A leaf spring or other resilient member is anchored adjacent the snap spring to control the force of snap over when the switch opens or is reset to the closed position.

6 Claims, 1 Drawing Sheet

RESET SWITCH WITH CONTROLLED FORCE STRENGTH SNAP-OVER

BACKGROUND OF THE INVENTION

1. Field of the Invention

The invention relates generally to electrical switches of the reset type commonly used in safety applications where the normally closed position of the switch is forced to a normally opened position when an unsafe condition is sensed. The switch is then required to be reset to the normally closed position by application of manual force. The present invention relates particularly to such a switch with means for controlling the snap over force of the movable conductive blade, or snap spring, therein.

2. Description of the Prior Art

Snap switches utilized as reset switches are generally well known in the art. Switches which do not return to the normally closed position when actuated to the normally open position with the reset plunger held depressed, or nonrecycling switches, which need to be manually reset are also generally known in the art. One variety of these switches has an anchor member which controls the position of the conductive blade, or snap spring, which moves between a conductive pole and nonconductive pole or the normally closed and normally open positions, respectively. The anchor is attached to the snap spring by means of a bowed portion of the snap spring thereby determining the middle, or snap over, position of the conductive member. That is, when the conductive blade is in the normally closed position, if it is forced over its center position by an activating plunger it will snap over and continue until its conductive pad is placed on the nonconductive pole. The conductive pad then remains there in the normally open position. A reset plunger is then required to be pressed manually, or with outside force, in order to push the conductive blade back over the center position where it snaps back into the normally closed position with its conductive pad resting on the conductive pole so that the circuit is again connected. When the conducting blade snaps from the nonconductive pole to the conductive pole, considerable force is required. If the internal parts of the switch i.e. the anchor, and the bowed spring portion, are positioned too low, or towards the conductive pole, recycling, or bounce back of the switch to the normally closed position results in unwanted current flow through the switch. If the internal parts are positioned too high there may be insufficient force generated by the reset plunger to return the snap spring to the conductive pole.

There is therefore a need for a mechanism for controlling the force of snap over, or movement, of the conductive blade when it moves between the normally closed and normally opened positions.

SUMMARY OF THE INVENTION

It is therefore an object of the present invention to provide a force controlling member for the conductive blade of a reset switch in order to eliminate the consequences of excessive force during snap over of the conductive blade. It is another object of the present invention to improve the safety and performance of such types of reset switches. In the preferred embodiment a conductive metallic leaf spring is anchored with the anchored end of the conductive blade. And the free end of the leaf spring member is placed adjacent the conductive blade so as to aid in controlling the force of its snap over movement.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
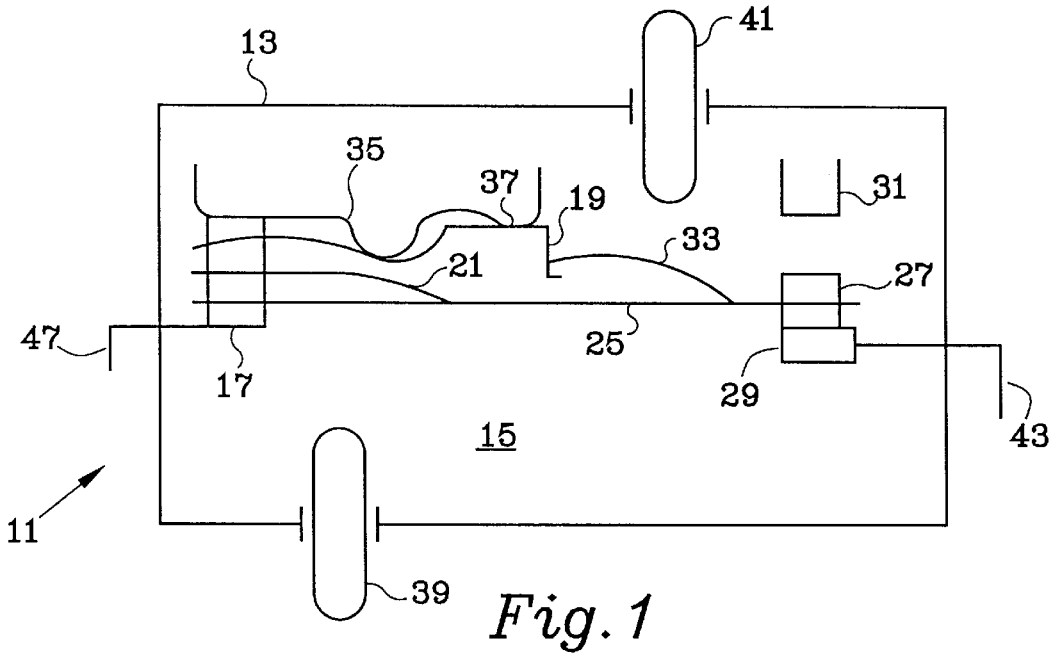
FIG. 1 is a side interior view of a reset switch according to the present invention.

Throughout the Description of the Preferred Embodiment, like components will be identified by like reference numerals.

Figure 2:
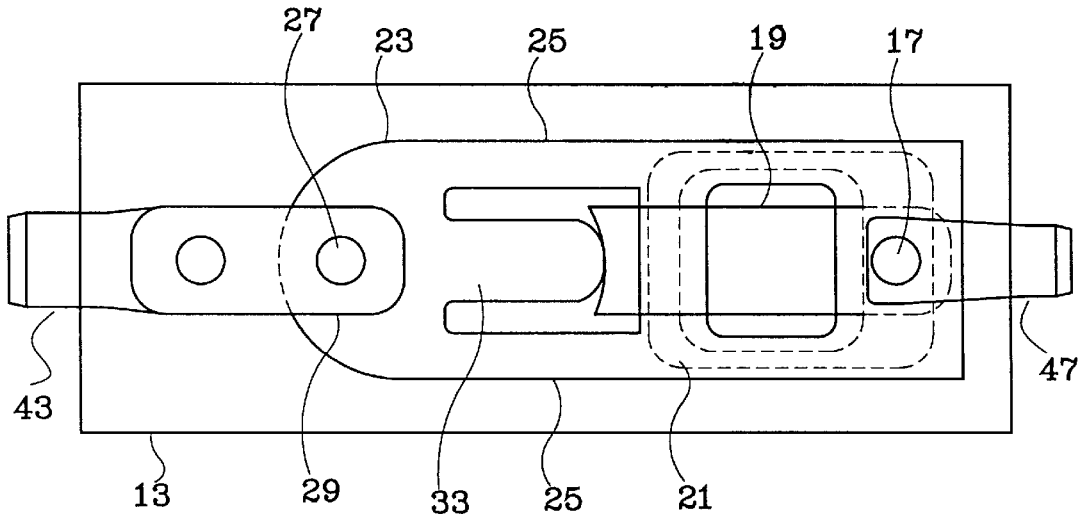
FIG. 2 is a bottom view of the reset switch with the bottom of the casing and activating plunger removed therefrom.

As seen in FIG. 1, a reset switch 11 is comprised of a casing 13 for the containment and positioning of the operative parts of the switch 11. The casing 13 generally defines the central cavity 15. Within the cavity 15 is a stake 17 for affixing within the interior an anchor 19, a leaf spring 21, and a conductive blade 23, all of which extend therefrom in cantilevered fashion in the direction of the middle of the central cavity 15. The conductive blade 23, or snap spring, is commonly comprised of stamped conductive metal and has outer arms 25 (FIG. 2) extending the length thereof and carrying a conductive pad 27. The conductive pad 27 on the free end of conductive blade 23 makes contact with either the conductive pole 29 or a nonconductive pole 31, representing the normally closed and normally open positions of the switch 11 respectively. Although contact 31 is called "nonconductive", this is in reference to the ordinary current path of the switch. The contact 31 could be made of conductive material if necessary for other purposes. The conductive blade 23 further has a central member 33 which is formed into a (U) shaped portion when attached at its free end to the anchor 19. Anchor 19 is fixedly positioned against bosses 35, 37 formed in the casing material to aid in vibration resistance of the switch mechanism.

External contacts 43, 47, for conductive pole 29 and for conductive members attached to stake 17, respectively, are shown extending outside of casing 13. It will be understood by the ordinarily skilled artisan that these external contacts may be constructed and arranged in any of a variety of configurations.

An activating, or pin, plunger 39 extends from the exterior of the case to the interior of the casing. The exterior portion of the plunger 39 is, for example, meant to interface with a bi-metal expansion member of a heating unit or the like such that when the bi-metal expands the pin plunger is pushed against the conductive blade 23 in its normally closed position in order to push the conductive blade over its center position whereupon it will snap over to rest against the nonconductive pole 31 thereby opening the circuit. A reset plunger 41 on the opposite side of the casing 13 is then manually depressed to force the conductive blade 23 in the opposite direction back over its center position whereupon it again snaps over into contact with the conductive pole thus resetting the switch and establishing the normal current path of the switch.

In the preferred embodiment a conductive leaf spring 21 is shown in FIG. 1 as placed between the conductive blade 23 and the anchor 19 and positioned so as to dampen the force of movement of the conductive blade 23 when it moves from the normally closed position to the normally open position. The leaf spring may be referred to as a force riser or a resilient member suitable for controlling the force of the conductive blade movement. It will be appreciated by those having ordinary skill in the art that the leaf spring may also be constructed and arranged in a variety of positions such that it might, for example, regulate the force of snap over when the conductive blade is moving from the normally opened position to the normally closed position. It would also be appreciated that there may be a pair, or plurality, of springs placed so as to regulate the force of snap over in either direction. The spring, or resilient member, may also have its terminal end secured, free floating as shown, or resting against a positive stop. While the preferred embodiment has described the force controlling member as a conductive leaf spring 21 it will be appreciated that a variety of other resilient members or materials may be used in place of a leaf spring in order to control the snap over force of the conductive blade 23.

Although the present invention has been described in considerable detail according to the embodiment presented herein, it will be appreciated that many other embodiments are within the scope of the present invention as described by the appended claims.

The embodiments of the invention in which an exclusive property or right is claimed are defined as follows:

1. A reset switch comprising:

a) a casing containing an electrical contact stake;

b) an anchor attached at a first end thereof to said electrical contact stake and supported by said casing;

c) a reset plunger for forcing a conductive blade to a normally closed position; d) a conductive blade with a first end attached at the electrical contact stake and a second end movable between a conductive pole and a nonconductive pole;

e) a conductive blade central member attached at a first end to said anchor and at a second end to said conductive blade; and f) a resilient member separate from said conductive blade affixed between said anchor and said conductive blade for moderating the force of said conductive blade movement between said conductive pole and said nonconductive pole; and g) an activating plunger for forcing said conductive blade to an open position.

2. A reset switch according to claim 1, wherein:

the anchor, the resilient member and the conductive blade are all attached to said electrical contact stake.

3. A reset switch according to claim 1, wherein said anchor is substantially "L" shaped.

4. A reset switch according to claim 3, wherein:

a long leg of said "L" shape is supported by said casing.

5. A reset switch according to claim 1, wherein:

said resilient member is composed of conductive metal.

6. A reset switch according to claim 1, wherein:

said resilient member is a leaf spring.

* * * * *